US006041564A

United States Patent [19]

Shirey

[11] Patent Number: 6,041,564

[45] Date of Patent: Mar. 28, 2000

[54] CLINCHED DOUBLE WEB GRID TEE

[75] Inventor: Richard Shirey, Vermilion, Ohio

[73] Assignee: USG Interiors, Inc., Chicago, Ill.

[21] Appl. No.: 09/036,238

[22] Filed: Mar. 6, 1998

[51] Int. Cl.[7] ..... E04B 9/24

[52] U.S. Cl. ..... 52/506.07; 52/731.7; 52/733.1; 52/745.19; 29/897.312; 29/897.35; 29/432.2; 29/21.1

[58] Field of Search ..... 52/506.07, 731.7, 52/733.2, 729.5, 733.1, 729.2, 745.19, 650.1, 667; 29/897.3, 897.31, 897.312, 897.35, 432.2, 509, 512, 514, 515, 521, 21.1

[56] References Cited

U.S. PATENT DOCUMENTS

| | | | |
|---|---|---|---|
| 2,457,148 | 12/1948 | Hall et al. | 52/377 |
| 3,082,850 | 3/1963 | Weening | 29/509 X |
| 3,084,401 | 4/1963 | Findlay | 52/667 X |
| 3,160,131 | 12/1964 | George et al. | 52/512 |
| 3,965,632 | 6/1976 | Rousey | 52/506.07 X |
| 3,979,874 | 9/1976 | Cubbler, Jr. et al. | 52/506.07 X |
| 4,206,578 | 6/1980 | Mieyal | 52/506.07 X |
| 4,462,198 | 7/1984 | Sharp | 52/506.07 X |
| 4,489,529 | 12/1984 | Ollinger et al. | 52/506.07 X |
| 4,679,375 | 7/1987 | Shirey | 52/506.07 X |
| 4,989,387 | 2/1991 | Vukmanic et al. | 52/667 |
| 5,592,848 | 1/1997 | Bodnar | 29/897.3 X |
| 5,839,246 | 11/1998 | Ziegler et al. | 52/506.7 |
| 5,979,055 | 11/1999 | Sauer et al. | 29/897.35 |

FOREIGN PATENT DOCUMENTS

| | | | |
|---|---|---|---|
| 73317 | 6/1960 | France | 52/635 |
| 3525139 | 1/1987 | Germany | 52/506.07 |

OTHER PUBLICATIONS

Donn Products, Inc. Drawing No. A1.742 dated Sep. 29, 1988.

Donn Products, Inc. Drawing No. B1.742.1 dated Oct. 6, 1982.

Donn Products, Inc. Drawing No. B1.742.2 dated Jun. 17, 1974.

Donn Products, Inc. Drawing No. A1.743 dated Jun. 19, 1974.

Donn Products, Inc. Drawing No. A1.743.1 dated Jun. 21, 1974.

Donn Products, Inc. Drawing No. A1.743.2 dated May 7, 1974.

Donn Products, Inc. Drawing No. A1.743.3 dated May 2, 1975.

Donn Products, Inc. Drawing No. A1.743.4 dated Apr. 25, 1975.

Donn Products, Inc. Drawing No. A1.743.5 dated Apr. 25, 1975.

Donn Products, Inc. Drawing No. A1.743.6 dated Aug. 29, 1975.

(List continued on next page.)

*Primary Examiner*—Laura A. Callo

*Attorney, Agent, or Firm*—Pearne, Gordon, McCoy & Granger LLP

[57] ABSTRACT

A grid tee of the double-web type in which the elements of the web are tied together by a plurality of clinched openings spaced apart along the length of the grid tee. The clinched openings are sized and shaped for receiving wires which support the grid tee from a superstructure of a building. The clinched openings are created in sequential operations of punching holes through the web elements, extruding edge portions of the web elements about the punched holes, and rolling-over the extruded edge portions to clinch the web elements together.

16 Claims, 2 Drawing Sheets

OTHER PUBLICATIONS

Donn Products, Inc. Drawing No. A1.743.7 dated Oct. 7, 1975.

Donn Products, Inc. Drawing No. A1.743.8 Oct. 14, 1975.

Donn Corporation Drawing No. A1.743.9 dated Mar. 5, 1982.

Donn Corporation Drawing No. A1.743.10 dated Aug. 2, 1982.

Donn Corporation Drawing No. A1.743.11 dated Aug. 2, 1982.

Donn Corporation Drawing No. A1.743.12 dated Aug. 26, 1982.

Donn Corporation Drawing No. A1.743.13 dated Feb. 2, 1982.

Donn Products, Inc. Drawing No. B1.743.15 dated Apr. 11, 1983.

Donn Incorporated Drawing No. A1.743.14 dated Apr. 8, 1983.

Donn Incorporated Drawing No. A1.743.16 dated Oct. 14, 1983.

CLINCHED DOUBLE WEB GRID TEE

BACKGROUND OF THE INVENTION

The present invention generally relates to grid tees for suspended ceilings and, more specifically, to grid tees of the double-web type.

A common grid tee construction includes a metal strip formed into an upper bulb, a vertically extending double web, and oppositely extending flanges. Punched slots are typically provided in the double web for receiving connector clips of cross tees. Punched holes are also typically provided in the double web for receiving wires above the ceiling tiles to support the grid tee from a superstructure of the building.

It can be important for added torsional strength of the grid tee to tie the elements of the double web together. U.S. Pat. No. 4,489,529 to Ollinger et al. disclosed several methods for joining the web elements together, such as using hot melt adhesive, welds, or a lancing pattern. These methods, however, may be difficult and/or expensive to implement in a high-speed manufacturing operation. Additionally, the methods may interfere with tooling and/or critical parts of the tee such as the slots and the punched holes. Accordingly, there is a need in the art for an improved grid tee of the double-web type.

BRIEF SUMMARY OF THE INVENTION

The present invention provides a grid tee of the double-web type for a suspended ceiling which overcomes at least some of the above noted problems. The grid tee is provided with a plurality of clinched openings along the length of the grid tee which can both tie the elements of the web together and receive wires for supporting the grid tee. According to the present invention, the grid tee includes sheet metal folded to form a longitudinally extending double web. The double web has a cross section with two integral and vertically extending web elements each formed by a layer of the sheet metal and a pair of diverging flanges each integral with an associated one of the web elements. The web elements are locked together in abutting contact by a plurality of clinched openings integrally formed in the web elements. The clinched openings are longitudinally spaced from one another along the length of the grid tee. At least one of the web elements has edge portions wrapped around or rolled over the other web element at the clinched openings to clinch the web elements together. The wrapped edge portions have a projection on a vertical plane greater than the wall thickness of the web elements whereby the torque strength of the tee is increased. In the preferred embodiment of the invention, the clinched openings are circular-shaped and the edge portions are wrapped or rolled over about the entire periphery of each of the clinched openings.

According to another aspect of the invention, the plurality of clinched openings are formed along the length of the grid tee by sequential press operations. A first press operation includes punching a plurality of holes through the web elements. The punched holes are longitudinally spaced-apart along the length of the tee. A second press operation includes bending edge portions of the web elements at the punched holes. A third press operation includes wrapping or rolling-over the bent edge portions to clinch the web elements together.

BRIEF DESCRIPTION OF THE SEVERAL VIEWS OF THE DRAWING

These and further features of the present invention will be apparent with reference to the following description and drawings, wherein.

DETAILED DESCRIPTION OF PREFERRED EMBODIMENTS

Figure 1:
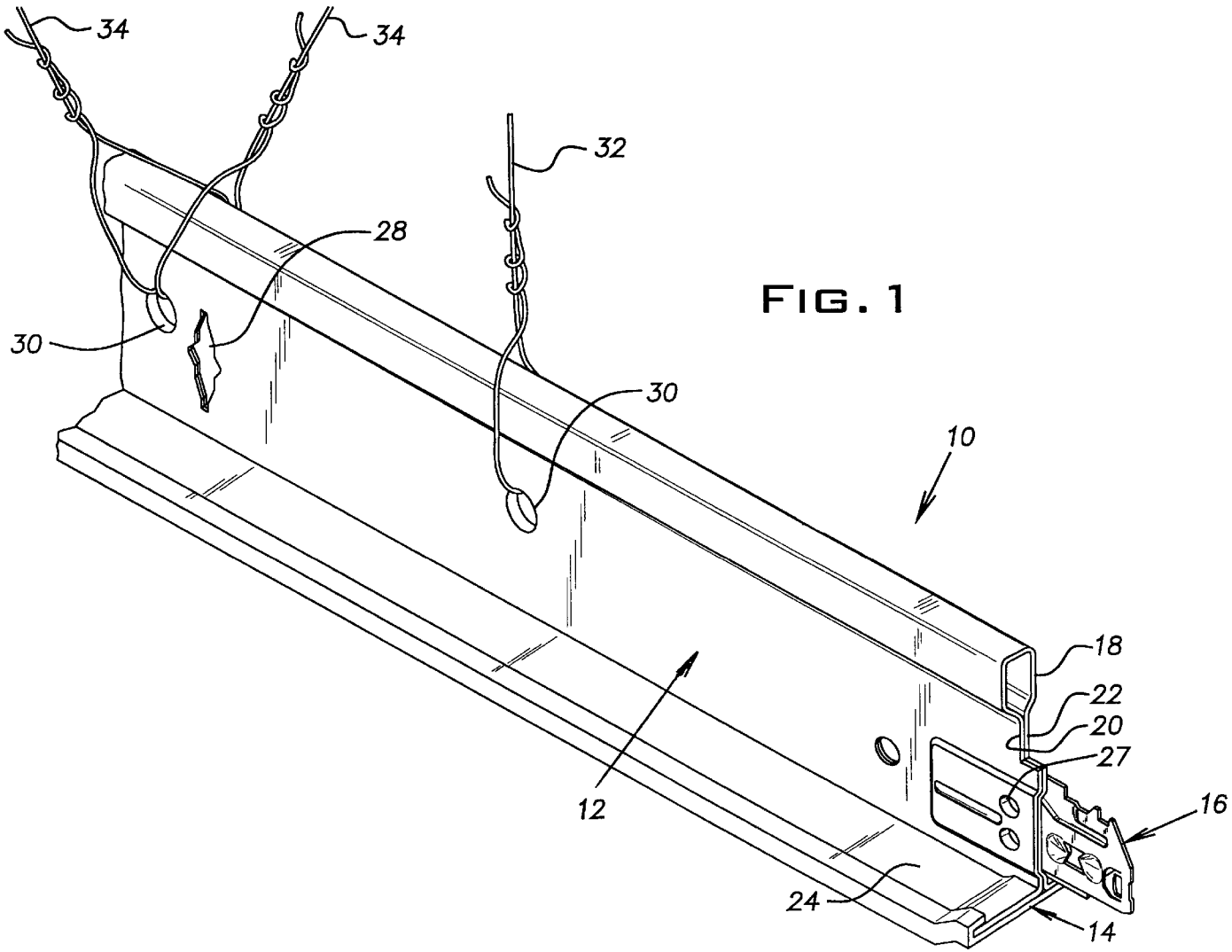
FIG. 1 is a perspective fragmentary view of a tee for a suspended ceiling grid having clinched openings according to the present invention.
Figure 2:
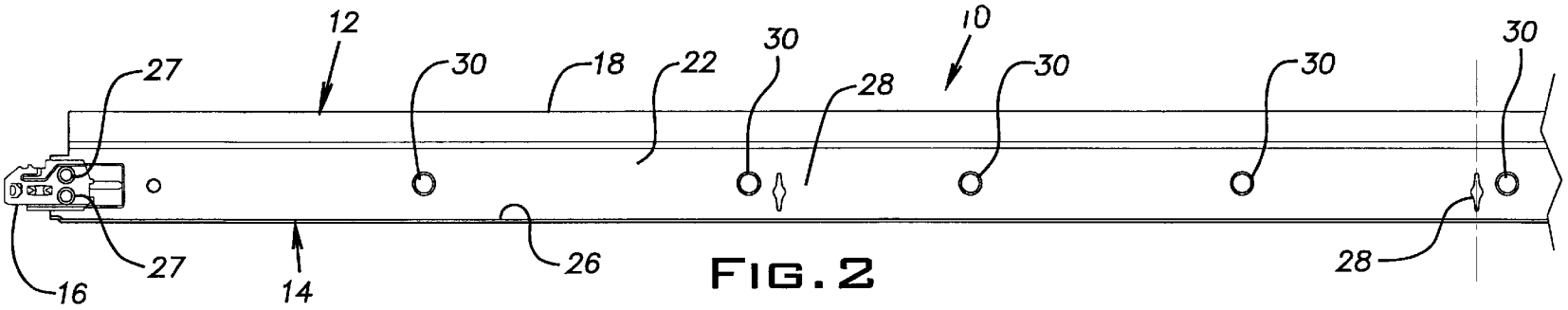
FIG. 2 is a fragmentary elevational view showing the opposite side the tee of FIG. 1.
Figure 3:
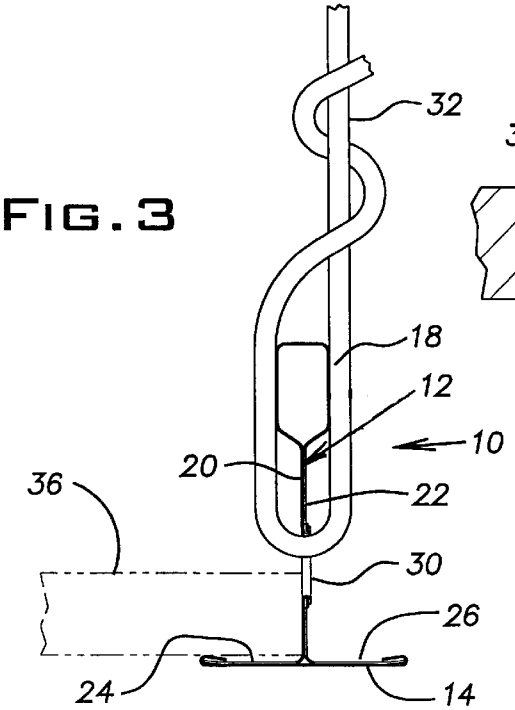
FIG. 3 is a cross-sectional view of the tee of FIG. 1 showing one of the clinched openings.

FIGS. 1–3 illustrate a runner or grid tee 10 for a suspended ceiling according to the present invention. As understood by those skilled in the art, the grid tee 10 can be either a main tee or a cross tee. The grid tee 10 of the illustrated embodiment includes a double web 12, a cap 14 covering the bottom of the double web 12, and a pair of connector clips 16 attached to opposite ends of the double web 12.

The double web 12 is formed of a single strip of metal which is bent, preferably by roll forming techniques known in the art, into the desired cross-sectional configuration. The double web 12 is preferably formed from steel, which is suitably painted, coated, or otherwise protected against corrosion.

The strip stock is bent or folded in a known manner along lines parallel to its longitudinal direction to produce an upper bulb 18, two web elements 20, 22, and lower flanges 24, 26, all integral with one another. The web elements 20, 22 are generally flat and vertically extend in a side-by-side manner. The flanges 24, 26 are generally flat and perpendicularly extend from the lower edge of the web elements 22, 24 in opposite directions. The top of the web elements 20, 22 are generally held together by the bend or fold located at the upper bulb 18.

The cap 14 is also formed of a single strip of metal which is bent, preferably by roll forming techniques known in the art, into the desired cross-sectional configuration. The cap 14 is preferably formed from steel which is suitably painted.

The cap 14 is generally flat and is located adjacent the under side of the flanges 24, 26. The cap 14 is wrapped around the outer edges of the flanges 24, 26 to secure the cap 14 to the double web 12 and to hold the bottom of the web elements 20, 22 together in adjacent relationship. The cap 14 covers the unsightly transition between the web elements 20, 22 and the diverging flanges 24, 26 to provide a more visually appealing finished look to the grid tee 10. It is noted, however, that the scope of the present invention includes grid tees 10 having a double web 12 without a cap 14.

The connector clips 16 are permanently attached to the ends of the double web 12 in a known manner. Preferably, the connector clips 16 are attached by a rivet-like formation 27 extruded from the web elements 20, 22 of the double web 12. The connector clips 16 can be of any known type for connecting grid tees 10 together. Openings or slots 28 are punched through the web elements 20, 22 of the double web 12 and are sized and shaped for cooperating with the connector clips 16 of cross tees 10 connected thereto.

A plurality of clinched holes or openings 30 are provided along the longitudinal length of the double web 12 which extend through the web elements 20, 22. The clinched openings 30 are formed out of the web elements 20, 22 themselves and mechanically lock the web elements 20, 22 together to increase the torsional strength or rigidity of the grid tee 10.

Integral rivet-like formations are extruded from the web elements 20, 22 about the periphery of the openings 30 to clinch or tie the web elements 20, 22 together. The formations are such that one of the web elements 20 has edge portions which wrap around the other web element 22 at the clinched holes 30 in a clinching manner as described in more detail hereinafter. It is noted that the wrapped edge portion at each of the clinched holes 30 has a projection on a vertical, cross-sectional plane which is greater than the wall thickness of the web elements 20, 22, whereby the torsional strength of the grid tee 10 is further increased. That is, the wrapped edge portions extend at least partially along a vertical portion of the clinched openings 30. Preferably, the elements 20, 22 are clinched about the entire periphery of each of the openings 30.

The clinched openings 30 can advantageously be used for suspending the grid tee 10 with support wires 32 or the like from the superstructure of a building. The clinched openings 30 can also be used for attaching splay wires 34 or the like to meet seismic requirements when necessary.

Ideally, the clinched openings 30 are located at generally uniformly spaced locations along the full length of the grid tee 12. The illustrated clinched openings 30 are circular but other suitable shapes can be utilized. The clinched openings 30 are large enough so that at least one of the support wires 32, typically a 12 gauge wire (about 0.105 inches), can pass therethrough. The clinched openings 30, however, are preferably larger so that multiple wires 32, 34 can pass therethrough and so that the torsional rigidity of the grid tee 10 is further increased.

As best shown in FIG. 3, the clinched openings 30, ideally, are vertically positioned to be at least partially above the top surface of ceiling tiles 36 supported on the flanges 24, 26 so that the wires 32, 34 can pass therethrough above the ceiling tiles 36. Therefore, an effective portion of the clinched openings 30 is preferably located above a horizontal plane located at least about 0.5 inches, corresponding to one typical thickness for ceiling tiles 36, above the flanges 24, 26 for providing an adequate space for the hanger wire 32 to pass through the clinched opening above the ceiling tile 36.

The web elements 20, 22, however, are preferably tied together near the bottom of the web elements 20, 22 to further increase the torsional rigidity of the grid tee 10. The clinched openings 30, therefore, are ideally sized and positioned to extend both above and below the top surface of the ceiling tiles 36.

Figure 4C:
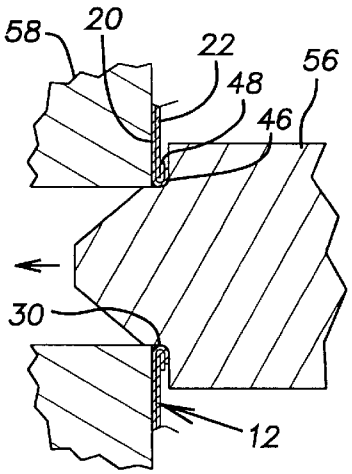
FIG. 4*c* is a schematic view of a third stage of forming the clinched openings in the tee of FIG. 1, wherein the extruded edges are rolled-over to clinch the double web together.
Figure 4B:
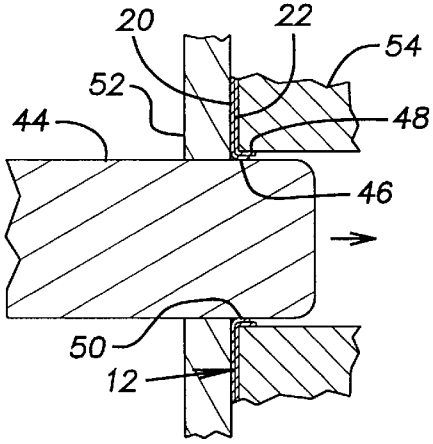
FIG. 4*b* is a schematic view of a second stage of forming the clinched openings in the tee of FIG. 1, wherein edge portions of the double web are extruded about the punched holes.
Figure 4A:
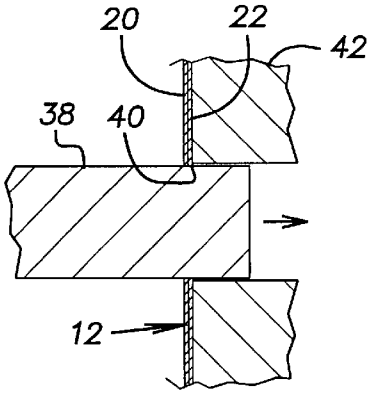
FIG. 4*a* is a schematic view of a first stage of forming the clinched openings in the tee of FIG. 1, wherein holes are punched through a double web along the length of the tee.

FIGS. 4*a* through 4*c* illustrate details of a preferred method and apparatus for forming the clinched openings 30. The double web 12 is passed through a progressive stage press. In the progressive stage press, the double web sequentially passes through at least three press operations or stations as described in more detail hereinafter.

FIG. 4*a* illustrates the first press station encountered by the double web 12. At the first press station, punches 38 are pressed through each of the web elements 20, 22 to punch slugs of material out of the web elements 20, 22 and form holes 40 therethrough. The punches 38 have sharp cutting edges capable of cooperating with a backing plate or die 42 to shear the slugs completely from the web elements 20, 22.

FIG. 4*b* illustrates the second press station encountered by the double web 12. At the second press station, forming tools 44 are pressed through the punched holes 40 in the web elements 20, 22 to bend and extrude the material encircling the punched holes 40. Extruded in this manner, cylindrically-shaped edge portions 46, 48 perpendicularly extend from the web elements 20, 22 in the same direction, wherein the first extruded edge portion 46 is located within the second extruded edge portion 48. The extruded edge portions 46, 48 preferably encircle the entire periphery of the formed holes 50. It is noted that the punched holes 40 are enlarged by the forming tools 44 to obtain the formed holes 50 which are the desired size of the clinched openings 30. Support plates 52, 54 are preferably provided at the sides of the double web 12.

FIG. 4*c* illustrates the third press station encountered by the double web 12. At the third press station, forming tools 56 are pressed through the formed holes 50 in the opposite direction to fold or roll-over the edge portions 46, 48 and clinch the web elements 20, 22 together. Folded in this manner, the edge portions 46, 48 are generally parallel to the remainder of the web elements 20, 22 so that the double web 22 has a thickness encircling the clinched openings 30 which is about four times the thickness of one of the web elements 20, 22. The edge portion 48 of the second web element 22 is folded back adjacent the second element 22 while the edge portion 46 of the first web element 20 is folded around and onto the folded edge portion 46 of the second element 22. It is noted that the folded edge portions 46, 48 remove sharp edges of the web elements 20, 22 from the clinched openings 30 and provide an enlarges bearing surface in a grommet-like manner. A backing plate 58 is provided at the opposite side of the double web 12 to cooperate with the forming tools 56.

It will be understood that ordinarily all the clinched openings 30 along the length of the grid tee 10 are produced simultaneously in the press. Other press operations such as, for example, forming the connector clip slots 28 or attaching the connector clips 16 can be completed simultaneously or sequentially with the above-described press operation stages.

It is noted that variations to the above-described preferred method can be made within the scope of the present invention. For example, the punching and extruding of the first and second press stations can be replaced with a single pierce punching or burst extrusion punch station. The advantage of such a punch station is that it provides a slugless operation. However, it is believed that such a punch station results in a lower increase in the torsional strength of the grid tee 10 than the preferred method described hereinbefore.

The stock forming the double web of the described grid tee can be, for example, about 1.5 inches tall with web elements about 1.0 inch tall, and clinched openings having a diameter of about 0.37 inches and centers located between about 0.47 to 0.625 inches from the bottom of the web tee. Such clinched openings can be formed from punched holes having a diameter of about 0.265 inches. The sheet stock of the double web when made of steel can have a nominal thickness of about 0.016 inches. For such a grid tee having a nominal length of about 4 feet, about 9 clinched holes are provided with a nominal center-to-center spacing of between about 4 to 6 inches. For such a grid tee having a nominal length of about 2 feet, about three clinched holes are provided with a nominal center-to-center spacing of about 4 to 5 inches.

Although particular embodiments of the invention have been described in detail, it will be understood that the invention is not limited correspondingly in scope, but includes all changes and modifications coming within the spirit and terms of the claims appended hereto.

What is claimed is:

1. A grid tee for a suspended ceiling comprising sheet metal folded to form a longitudinally extending double web with a cross section having two integral and vertically extending web elements each formed by a layer of the sheet metal and a pair of diverging flanges each integral with an associated one of the web elements, the web elements being locked together in abutting contact by a plurality of clinched openings integrally formed therein, the openings being longitudinally spaced from one another along the length of the grid tee, such that they exist at locations adjacent the mid-length of the tee at least one of the web elements having edge portions wrapped in opposite longitudinal directions around the other web element at the clinched openings to clinch the web elements together, the wrapped edge portions lying in both longitudinal directions having a projection on a vertical plane greater than the wall thickness of the web elements whereby the torque strength of the tee is increased.

2. The grid tee according to claim 1, wherein said clinched openings are circular.

3. The grid tee according to claim 2, wherein said wrapped edge portions extend around the entire periphery of the clinched openings.

4. The grid tee according to claim 2, wherein said clinched openings are large enough for passage of multiple 12 gauge wires therethrough.

5. The grid tee according to claim 1, wherein said wrapped edge portions extend around the entire periphery of the openings.

6. The grid tee according to claim 1, wherein said clinched openings are vertically located at about the center of the web elements.

7. The grid tee according to claim 1, wherein said clinched openings are large enough for passage of multiple 12 gauge wires therethrough.

8. The grid tee according to claim 1, wherein a portion of said clinched openings effective for passage of a support wire therethrough is located at least about 0.5 inches above the diverging flanges.

9. The grid tee according to claim 1, wherein said clinched openings are substantially uniformly spaced along the length of the grid tee.

10. A roll formed sheet metal tee for a suspended ceiling grid comprising an elongated double web having opposite ends and being formed of a single folded strip of metal, the metal being folded to form two web elements and oppositely extending flanges each joined to a lower edge of an associated one of the web elements, the web elements having slots for receiving connectors of cross tees and a plurality of clinched openings for receiving wires to support the tee from a superstructure of a building, the clinched openings being longitudinally spaced apart along the length of the tee such that they exist at locations adjacent the mid-length of the tee and being formed out of the web elements themselves to mechanically lock the web elements together and increase the torsional strength of the tee, the clinched openings being large enough to receive multiple 12 gauge wires.

11. The tee according to claim 10, wherein said clinched openings are circular.

12. The tee according to claim 11, wherein said clinched openings have a diameter large enough for passage of multiple 12 gauge wires therethrough.

13. The tee according to claim 10, wherein said clinched openings are sized large enough for passage of multiple 12 gauge wires therethrough.

14. The tee according to claim 10, wherein a portion of said clinched openings effective for passage of a support wire therethrough is located at least 0.5 inches above the flanges.

15. The tee according to claim 10, wherein said clinched openings are uniformly spaced along the length of the grid tee.

16. A method of making a grid tee for a suspended ceiling comprising the steps of forming an elongated tee by roll forming a strip of metal into a desired cross-sectional shape, the shape including a generally planar double web of two web elements of the strip and diverging flanges each joined to a lower edge of an associated one of the web elements, punching a plurality of holes at locations longitudinally spaced along the length of the tee including locations adjacent its mid-length, bending edge portions of the web elements at the punched holes in both longitudinal directions, and rolling-over the bent edge portions to clinch the web elements together.

* * * * *